US006899290B2

(12) United States Patent
Varble et al.

(10) Patent No.: US 6,899,290 B2
(45) Date of Patent: May 31, 2005

(54) FUEL SWIRLER PLATE FOR A FUEL INJECTOR

(75) Inventors: Daniel L. Varble, Henrietta, NY (US); Harry R. Mieney, Byron, NY (US); Richard L. Cooper, LeRoy, NY (US); David Rogers, Henrietta, NY (US); Kevin J. Allen, Avon, NY (US)

(73) Assignee: Delphi Technologies, Inc., Troy, MI (US)

( * ) Notice: Subject to any disclaimer, the term of this patent is extended or adjusted under 35 U.S.C. 154(b) by 146 days.

(21) Appl. No.: 10/313,081

(22) Filed: Dec. 6, 2002

(65) Prior Publication Data

US 2003/0234302 A1 Dec. 25, 2003

Related U.S. Application Data

(60) Provisional application No. 60/391,007, filed on Jun. 24, 2002.

(51) Int. Cl.[7] ..... F02M 61/00

(52) U.S. Cl. ..... 239/533.12; 239/596; 239/463

(58) Field of Search ..... 239/533.12, 463, 239/596

(56) References Cited

U.S. PATENT DOCUMENTS

| | | | | |
|---|---|---|---|---|
| 5,232,163 A | * | 8/1993 | Grytz | 239/405 |
| 6,029,913 A | * | 2/2000 | Stroia et al. | 239/533.12 |
| 6,142,390 A | | 11/2000 | Nordstrom et al. | |
| 6,145,761 A | * | 11/2000 | Muller et al. | 239/533.12 |
| 6,179,227 B1 | | 1/2001 | Ren et al. | |
| 6,244,525 B1 | | 6/2001 | Gallup et al. | |
| 6,296,199 B1 | | 10/2001 | Noller et al. | |
| 6,318,641 B1 | | 11/2001 | Knebel et al. | |
| 6,382,532 B1 | | 5/2002 | French et al. | |
| 6,382,533 B1 | * | 5/2002 | Mueller et al. | 239/585.1 |
| 6,422,198 B1 | | 7/2002 | VanBrocklin et al. | |
| 6,575,382 B1 | | 6/2003 | Fischer et al. | |

FOREIGN PATENT DOCUMENTS

| | | | |
|---|---|---|---|
| DE | 197 36 684 | | 2/1999 |
| DE | 199 47 780 | | 4/2001 |
| WO | WO 02/045860 | * | 6/2004 |

* cited by examiner

*Primary Examiner*—Dinh Q. Nguyen
(74) *Attorney, Agent, or Firm*—Jimmy L. Funke

(57) ABSTRACT

A fuel swirler plate for improving atomization of fuel in a fuel injector. A plurality of identical fuel supply passages is formed in the plate, each passage including an outer fuel reservoir region; a region having converging walls wherein fuel is accelerated and turned partially tangential to the axis of the plate and fuel injector; a metering region wherein flow is regulated; and an exit region wherein the fuel is combined with similar fuel flows from the other passages to form a high velocity swirl annulus between the swirler plate and a pintle ball of the fuel injector. An advantage of the novel swirl plate over prior art plates is that, when the injector valve is closed, only a very small volume of fuel resides in the swirl annulus between the pintle ball and the exit region of the plate, and such residual fuel is urged rotationally and becomes the leading edge of a new vortex the next time the valve is opened, thus minimizing SAC spray formation. The present invention is useful in fuel cells, burners, and in both direct injection and port injection fuel injectors of internal combustion engines.

19 Claims, 5 Drawing Sheets

FUEL SWIRLER PLATE FOR A FUEL INJECTOR

RELATIONSHIP TO OTHER APPLICATIONS

The present application draws priority from a U.S. Provisional Application, Ser. No. 60/391,007, filed on Jun. 24, 2002.

TECHNICAL FIELD

The present invention relates generally to fuel injectors for injecting liquid fuel into internal combustion engines or fuel reformers; more particularly, to fuel injectors having pressure-swirl atomizers for providing a finely atomized fuel spray; and most particularly, to a pressure-swirl atomizer including a flat plate having converging swirler passages for providing an improved level of atomization.

BACKGROUND OF INVENTION

Fuel injectors are well known for supplying metered amounts of fuel to combustors such as internal combustion engines, and reformers such as hydrogen/reformate generators for fuel cells. In either case, it is highly desirable that the fuel spray created by these injectors be well atomized for essentially instantaneous vaporization upon entering the spray chamber, whether it be the injection port or firing chamber of an engine or the vaporizer chamber of a catalytic reformer. In a fuel cell, for example, this is a desirable since the liquid fuel is thereby inhibited from contacting the hot metal surfaces of the vaporizer chamber, thus preventing undesirable carbon formation and uncontrolled combustion.

Conventional port fuel injectors operate at lift pump pressures of less than 400 kPa and employ director-style spray tips. A conventional fuel director can have one to ten or more holes that define a spray pattern and flow rate of the injector. As the size and/or number of holes in the director is increased, the flow rate of the injector at a given pressure also increases. The diameter of the hole also determines the spray droplet size. As the hole diameter decreases, the droplet size also decreases desirably at a given pressure; however, if the hole diameter is too small, the holes are susceptible to plugging from fuel and combustion deposits. Therefore, the minimum practical lower limit for a director hole diameter is approximately 100 microns (0.1 mm). This hole size limits the minimum spray droplet size at a 400 kPa lift pump pressure to dv90's of approximately the diameter of the hole; and in practice most droplets are larger. Therefore, a physical barrier (hole diameter) limits the minimum droplet size obtainable with a director style injector spray tip. In addition, the director style spray tip generates sprays that are non-uniform and stringy in comparison to sprays generated by apparatus in accordance with the invention as detailed hereinbelow.

Pressure-swirl atomizers, capable of generating sprays in continuous systems such as paint sprayers and gas turbine nozzles, are well known. Pressure-swirl atomizers have also been applied to pulsed-spray applications, such as fuel cells and high-pressure gasoline fuel injectors, to provide finely atomized sprays.

A pressure-swirl atomizer has several advantages over director-plate atomizers traditionally used for pulsed spray applications. First, pressure-swirl atomizers can produce smaller droplets. This is especially evident at lower pressures, as required by port fuel injection systems. Also, pressure-swirl atomizers are less susceptible to plugging than director type atomizers. Additionally, pressure-swirl atomizers can generate uniform hollow-cone sprays that are most desirable in a direct cylinder injection application.

A disadvantage of prior art pressure-swirl atomizers is that large droplets of fuel, known in the art as a "SAC" spray, are released into the spray chamber at the beginning of each injection pulse. When the injector first opens, the fuel located between the swirler and the valve seat does not have rotational velocity. This fuel exits the injector axially in mostly non-atomized large droplets, not in a finely atomized cone. These large droplets in the SAC spray are undesirable because the fuel contained therein is generally non-metered and can also reach chamber surfaces where it can produce carbon formation in fuel cells, as well as higher emissions from internal combustion engines. Therefore, it is desirable to use an optimized swirler/nozzle design to produce very small droplets in a conical spray pattern as the fuel exits the injector.

Conventional pressure-swirl atomizers typically include a complex swirler constructed of powdered metal. Manufacturing costs associated with the use of powdered metal swirlers are relatively high. Other types of pressure-swirl atomizers utilize flat-plate swirlers stamped from sheet metal. This process typically limits their geometry to simple circular and straight-line passages to keep the stamping tool simple and durable. However, such limitations restrict the performance of the part. Additionally, this process can also result in sharp edges and abrupt transitions that can induce the flow to separate undesirably from the edges, resulting in cavitation erosion of the swirler and unpredictable flow patterns. Such flow separation is quite sensitive to edge conditions such as sharpness or burrs. Slight variations in edges can translate into non-uniformity in the produced parts and resulting flow variations.

What is needed is a pressure-swirl plate for a fuel injector that reduces the cost, flow variation, and transient spray development problems associated with prior art swirl plates, while maintaining their advantages over director-style atomizers.

It is a principal object of the present invention to optimize flat swirler plate geometry to optimize performance of a pressure-swirl atomizer.

It is a further object of the invention to simplify the construction and reduce the cost of producing a swirler-plate nozzle atomizer.

BRIEF DESCRIPTION OF THE INVENTION

Briefly described, a fuel swirler plate for improving atomization of fuel in a fuel injector includes a plurality, preferably six, of identical fuel supply passages formed in the plate. Each passage includes an outer reservoir region wherein fuel is received from a source; an inwardly converging region having converging passage walls wherein fuel from the reservoir region is both accelerated and turned partially in a direction tangential to the axis of the plate and fuel injector; a metering cross-section formed as a minimum cross-sectional area in the converging region; and an exit region wherein the fuel dispensed from each passage combines with similar fuel flows from the other passages to form a high velocity swirl annulus between the swirler plate and a pintle ball of the fuel injector valve. The valve seat is conical below the ball, such that the swirl annulus, in descending the seat toward the exit from the fuel injector body, is further accelerated into a vortex having a very high angular velocity. Upon exiting the fuel injector, the fuel vortex spreads substantially instantaneously into a predictable, controlled hollow cone wherein the fuel may become vaporized before striking a surface. An advantage of the novel swirler plate over prior art plates is that, when the injector valve is closed, only a very small volume of fuel resides upstream of the valve seat in the annular region between the pintle ball and the exit region of the plate; and further, such residual fuel, which can cause large SAC sprays in prior art arrangements, is urged rotationally and becomes the leading edge of a new vortex each time the valve is opened, thus minimizing SAC spray formation.

The present invention may be usefully applied to fuel cells, burners, high pressure (10–20 MPa) gasoline direct injection fuel injectors, and low pressure (200-400 kPa) port fuel injectors, and may also be applied to other continuous flow pressure-swirl atomizer applications.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
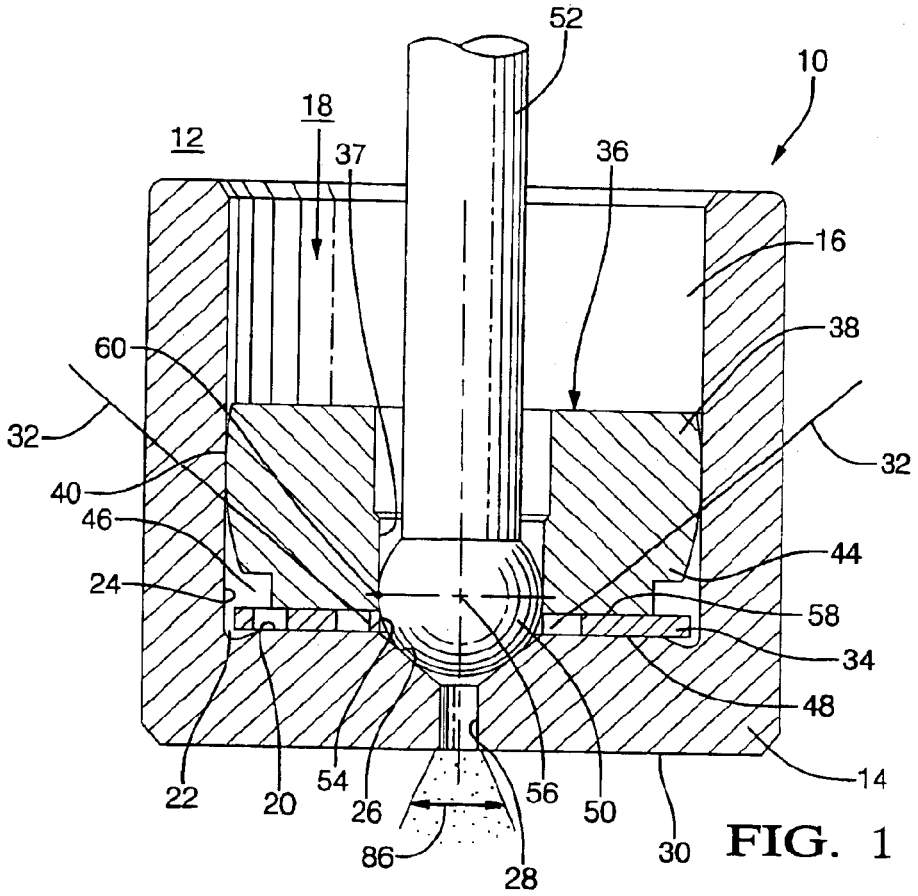
FIG. 1 is an elevational cross-sectional view, taken along line 1—1 in FIG. 2, of a fuel injector nozzle, including a flat pressure-swirl plate in accordance with the invention.
Figure 2:
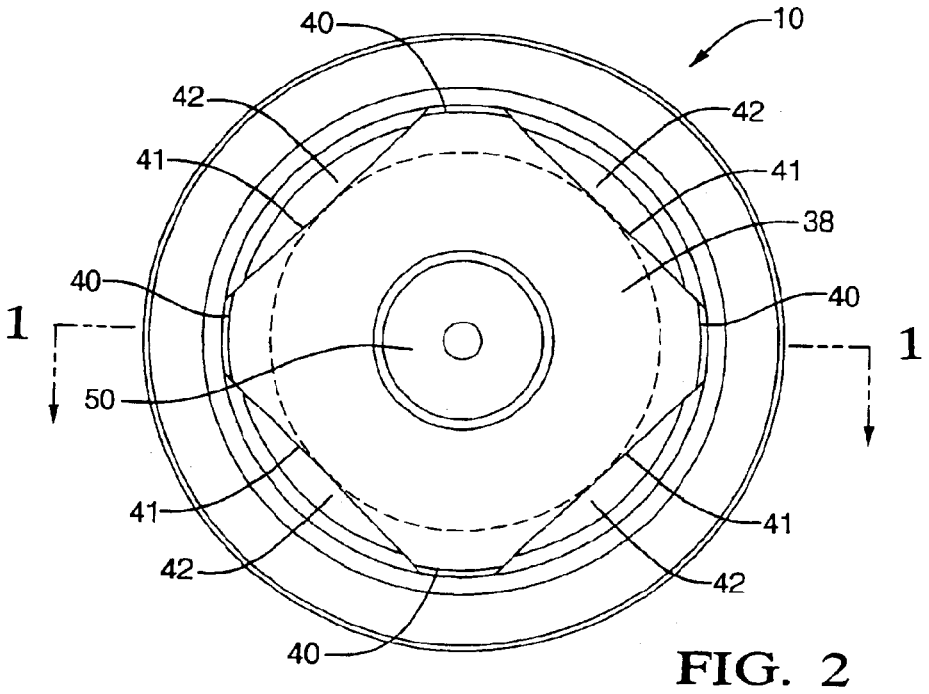
FIG. 2 is a top view of the apparatus shown in FIG. 1.

Referring now to the drawings, and particularly to FIGS. 1 and 2, nozzle 10 for incorporation into a fuel injector (shown schematically as 12) for an internal combustion gasoline or diesel engine, or a fuel reformer for a fuel cell (not shown). Nozzle 10 includes a nozzle body 14 having a bore 16 for receiving fuel 18 from a source in known fashion. Bore 16 terminates in a plate seat 20 which is preferably slightly undercut 22 at its juncture with bore wall 24. Coaxial with bore 16 and plate seat 20 is a frusto-conical valve seat 26 terminating in a cylindrical outlet passage 28 which opens axially through an end wall 30 of body 14. Valve seat 26 preferably has an included cone angle 32 of about 90°.

A flat pressure-swirl plate 34 in accordance with the invention is coaxially disposed on plate seat 20 and is retained thereupon by plate retainer 36 which is press-fit into bore 16 and itself has a central bore 37. The upper portion 38 of retainer 36 has a plurality of cylindrical faces 40, preferably three, four, or six, (six shown) separated by flats 41 and having a diameter slightly greater than the diameter of bore 16 for engaging wall 24 and for forming fuel flow passages 42 around retainer 36. The lower portion 44 of retainer 36 is preferably cylindrical and has a smaller diameter than upper portion 38 such that an annular fuel supply chamber 46 is formed adjacent plate 34, chamber 46 being in fluid communication with passages 42. The lower axial surface 48 of lower portion 44 is planar, as is the surface of plate seat 20, such that plate 34 is tightly sandwiched therebetween. Undercut 22 ensures that the swirl plate rests flatly in the counterbore.

Preferably, once body 14, plate 34, and retainer 36 are assembled, they are heat-treated as an assembly and diffusion bonded together. Then bore 37 and valve seat cone 26 are finish ground coaxially to precise size and roundness dimensions. The order of the process steps and the optional heat treat may be varied within the scope of the invention.

A valve head, preferably a spherical pintle ball 50, and attached pintle shaft 52 are disposed within bore 37 and through a central opening 54 in plate 34 such that ball 50 forms a valve seal with valve seat 26. The center 56 of sphere 50 is preferably slightly above the upper surface 58 of plate 34. The diameters of bore 37 and ball 50 are selected such that a very small annulus 60 exists therebetween, the preferred clearance being no more than about 5 $\mu$m, to minimize fuel leakage which would thereby bypass the swirl plate. Ball 50 is actuated axially of nozzle 10 to open and close the valve preferably via a conventional solenoid valve actuator (not shown), as is well known in the prior art.

Figure 3:
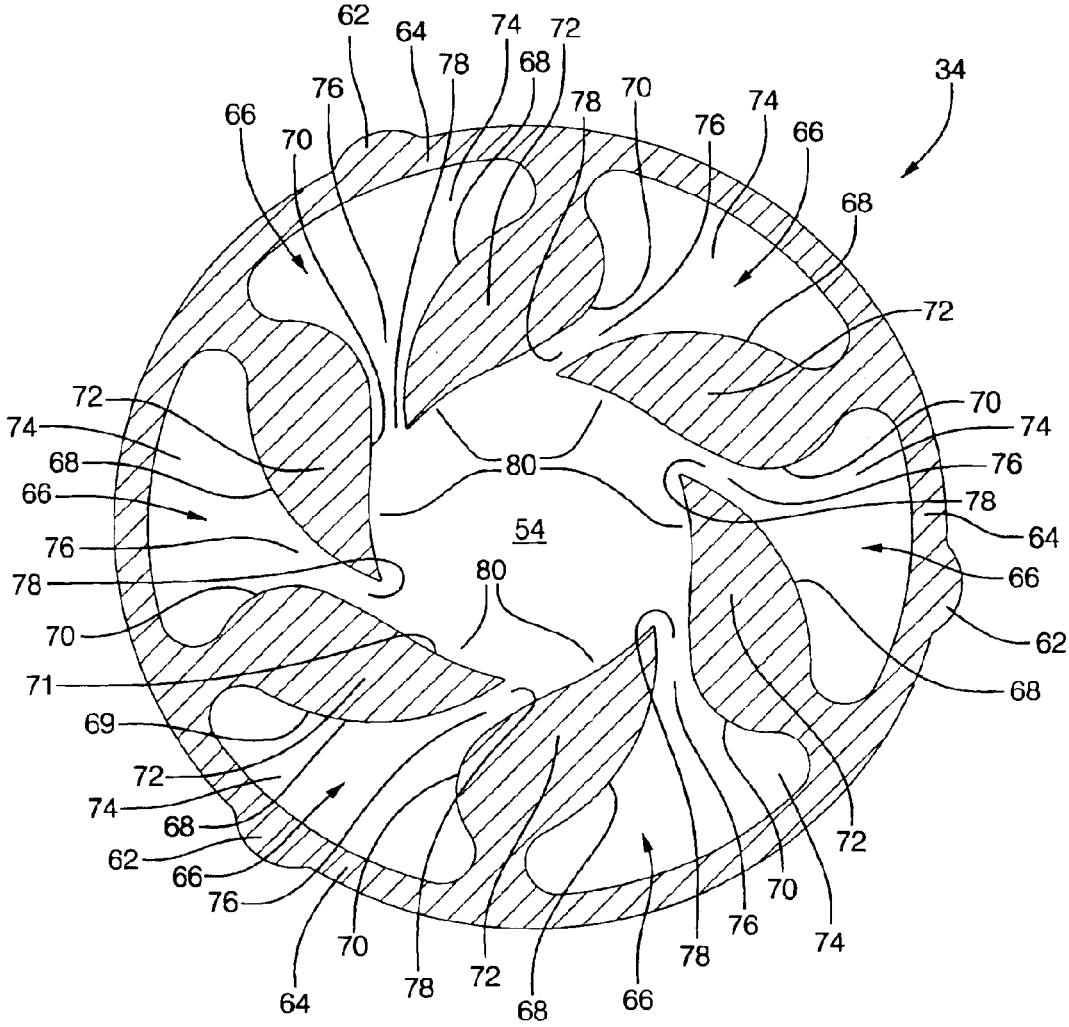
FIG. 3 is an equatorial cross-sectional view of the swirl plate shown in FIG. 1.

Referring now to FIG. 3, a flat pressure-swirl plate 34 in accordance with the invention is formed as by stamping or chemical etching from sheet stock, preferably full-hard stainless steel. The plate is relatively small and delicate, and its form must be accurately maintained during assembly of the nozzle. Plate 34 is circular in outline and during assembly is located concentrically on seat 20 in counterbore 16 by a plurality of spring bumps 62, preferably three equilaterally arranged, formed on the outer rim 64 of plate 34 that are compressed slightly against wall 24. Outer rim 64 of plate 34 flexes and acts as a spring so that the swirl plate is centered in the nozzle to prevent skewing of the fuel spray during operation of the fuel injector. Minor variations in diameter of bore 16 are compensated for by the compression of these springs.

Figure 4:
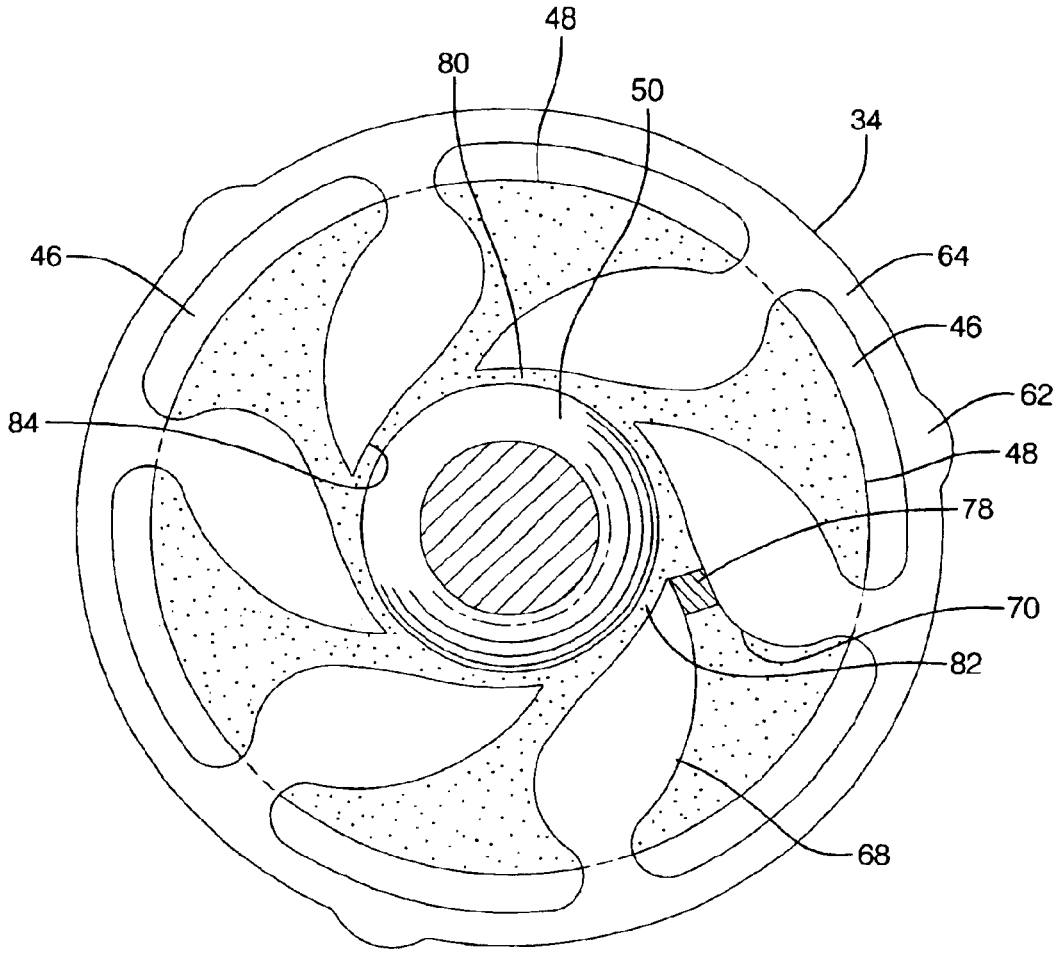
FIG. 4 is an axial view from below showing the relationship between the swirl plate, a swirl plate retainer, and a pintle ball valve head.

Plate 34 comprises a metal tracery outlining a plurality of identical fuel flow passages 66, preferably six as shown in FIGS. 3 and 4, hexagonally arranged about central opening 54 described above. Passages 66 are bounded axially by plate seat 20 and lower surface 48, as described above, and are bounded equatorially by outer rim 64 and first and second walls 68,70, respectively of lands 72 that extend inwards of outer rim 64. Each passage 66 includes several flow regions: an outer reservoir region 74 wherein fuel is received from annular chamber 46; an inwardly converging region 76 wherein walls 68,70 converge and wherein fuel from the reservoir region is both accelerated and turned partially in a direction tangential to the axis of the plate and fuel injector; a metering region 78 formed as a minimum cross-sectional area at the end of converging region 76, wherein the walls are substantially parallel and the ratio of length to width of the region is preferably about 1:1; and an exit region 80 wherein the fuel dispensed from each metering region 78 combines with similar fuel flows from the other passages to form a high velocity swirl annulus 82 between swirler plate 34 and pintle ball 50, as shown in FIG. 4.

When injection is desired, preferably, pintle shaft 52 is axially displaced upwards (with respect to FIG. 1), thereby removing ball 50 from mating engagement with seat 26. Ball 50 is guided straight away from the seat because of guide annulus 60. Pressurized fuel 18 inside injector 12 can then begin to flow out of the injector. The process is reversed to end injection.

The fuel flow path presented by the present invention is as follows. Fuel moves from bore 16 through passages 42 into annular chamber 46 and thence into regions 74 in swirl plate 34. At this point in the fuel flow, fuel velocity is relatively low and the pressure drop is minimal. Fuel then turns 90 degrees toward the axis of the nozzle. Flow velocity is still quite slow at this point; hence, conditions of surfaces and edges in regions 74 do not add variation to the flow rate or pressure drop. Now fuel enters converging region 76 between walls 68,70. It is an important feature of a swirl plate in accordance with the invention that fuel is prevented from losing wall contact and cavitating in this region, as occurs in prior art swirl plates. To this end, curved wall 68 is formed having a first blend radius 69 and curved wall 70 is formed having a second blend radius 71 in an opposite direction. As walls 68,70 converge in region 76, the flow accelerates as fuel moves towards metering region 78. The dimensions of metering region 78 are selected to produce the desired swirl velocity, and therefore the desired fuel spray angle at exit from outlet passage 28. A gradual reduction in flow cross-sectional area is essential to accelerating the fuel without causing the fuel to separate from the walls, which would add flow variation. It is also desirable that acceleration happen in a simple plane without adding rotation to the fuel. In a swirl plate in accordance with the present invention, flow velocity through the flow passages is kept low in areas where it can be difficult to control quality of the cut-out edges which can disrupt flow. The velocity is also kept low at locations where the flow must change direction around corners, as in changing direction from annular chamber 46 into passages 66. Then, in regions 76, the flow is gently accelerated into metering region 78. This results in repeatable flow with reduced variation part to part.

Referring to FIG. 4, edge 84 of lands 72 is tangent to the swirl annulus 82. The diameter of swirl annulus 82 is selected to be slightly larger than the diameter of pintle ball 50 at the axial location at which the annulus intersects the ball. As noted above, the intersection point is below the equator or center 56 of the pintle ball. This allows the equator of the pintle ball to be guided by bore 37. In addition to guiding the pintle ball 50, this arrangement, as noted above, also restricts fuel from bypassing the swirl plate and entering the swirl annulus 82 directly and without a tangential velocity.

Fuel enters swirl annulus 82 from metering region 78 at a high velocity, on the order of 130 meters per second. The swirling flow then moves downwards vertically along conical valve seat 26 between the seat and pintle ball 50 toward outlet passage 28. The diameter reduction as the fuel moves through the conic area further increases the rotational velocity. The fuel forms a thin sheet along the walls of outlet passage 28. The center of the passage contains only air and fuel vapor, no liquid. As the fuel exits passage 28 through wall 30, the fuel forms a conical spray pattern 86. The conical spray angle is determined by the ratio of axial to tangential (swirl) velocities. The total flow rate is determined by supply pressure and by the cross-sectional area of the nozzle. Other significant flow factors include the cross-sectional area of region 78, the diameter of swirl annulus 82, the size of the annular gap between pintle ball 50 and valve seat 26 when the valve is open, and the exit orifice diameter of outlet passage 28. By adjusting these parameters without undue experimentation, a desired spray angle and flow rate can be achieved.

The quality of fuel atomization is determined by the flow path through a fuel injector nozzle. Because flow is rapidly pulsed in normal operation, this process is a transient process. Therefore, how quickly the swirl is established is an important performance factor. To better understand the present invention, it is helpful to consider a prior art straight swirl flow passage (not shown). At low fuel flow velocities, such as when the injector first opens, nearly 100% of the passage area is used for flow. However, as flow rate increases, fuel begins to separate from the walls near the inlet edges, creating an effectively narrower passage. This contraction can vary greatly, depending upon the condition of the inlet edges, and can reduce the flow by up to 25% from the ideal. This effect is opposite of the desired. It is preferable to have a narrower passage initially, to quickly produce high velocities for reduced SAC spray, but also a wider passage, with higher flows, for less pressure drop. The converging walls of the present invention initially produce a higher velocity even though the passage is made approximately 25% narrower than a corresponding straight passage. This is possible because the converging shape prevents flow separation at the higher velocities. Thus, the initial fuel velocity in the present invention is higher, and therefore the SAC sprays are reduced.

Although FIGS. 1 and 2 illustrate incorporation of the invention in an inwardly-opening fuel injector, the invention is also applicable to outwardly-opening fuel injectors. The swirl for outwardly opening applications is established by similar methods and geometries as detailed for the inwardly-opening injector, except that the swirl velocity is reduced as the diameter increases along the seat cone, and an air-core is not produced because there is no exit orifice.

A flat swirl plate in accordance with the invention has also been applied to a port fuel injector. The resulting dv90s for this style injector are 10% to 20% smaller than that of a director style injector of similar flow. Comparable reductions in d32 numbers are also achieved. The injector fuel spray is also more uniform and cone shaped than as provided by the director style injector.

The flat plate geometry of the present swirl plate has the benefit of being easily manufactured, which lowers costs. There are several methods to manufacture a flat plate swirler, including, but not limited to, stamping and photo chemically machining (PCM). Typically, complex curves are difficult to stamp, but are very easy to PCM, which process can produce flat plate swirlers with low tooling cost and has the capability to form complex curves easily. Material choice is not limited by the PCM process. A full-hard stainless steel plate is preferred for increased durability and resistance to erosion, although this material may reduce the tool life for a stamped swirler plate.

Figure 5:
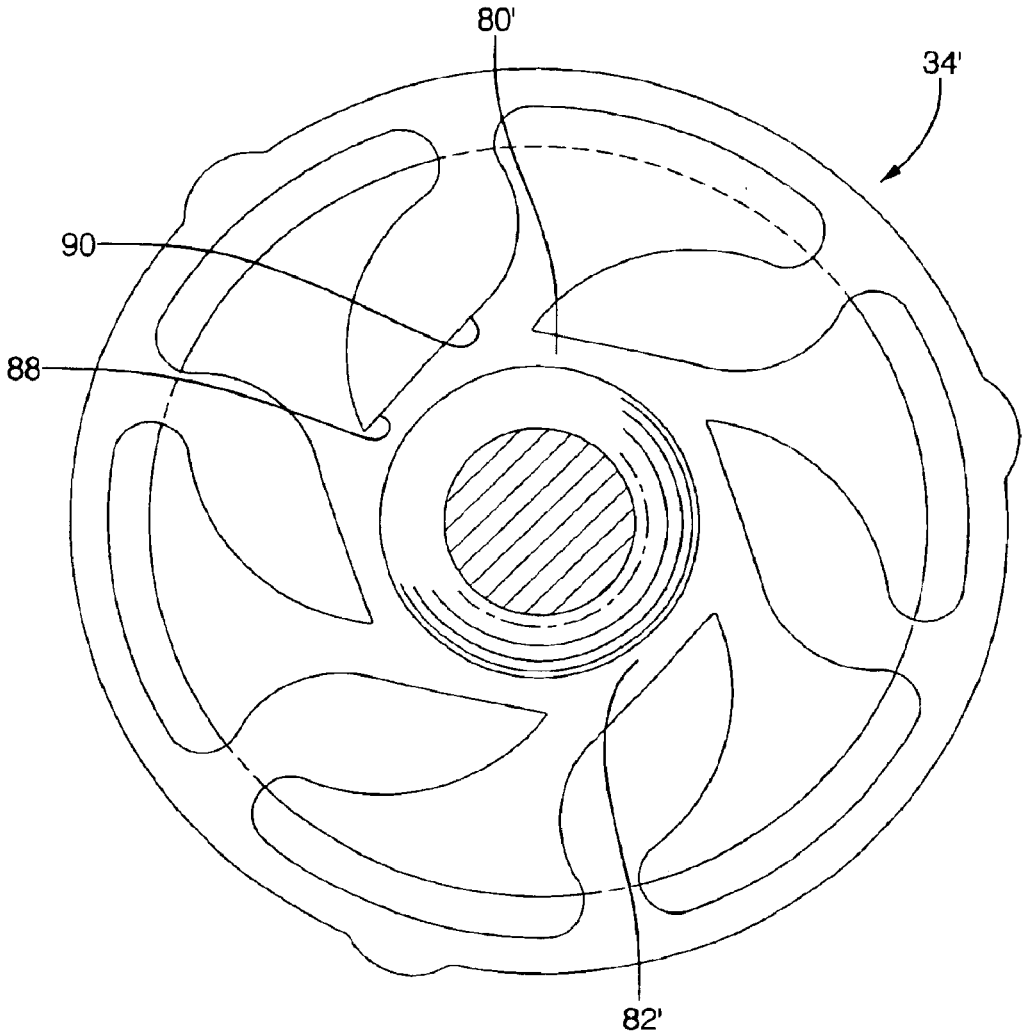
FIG. 5 is a second embodiment of a swirl plate.
Figure 6:
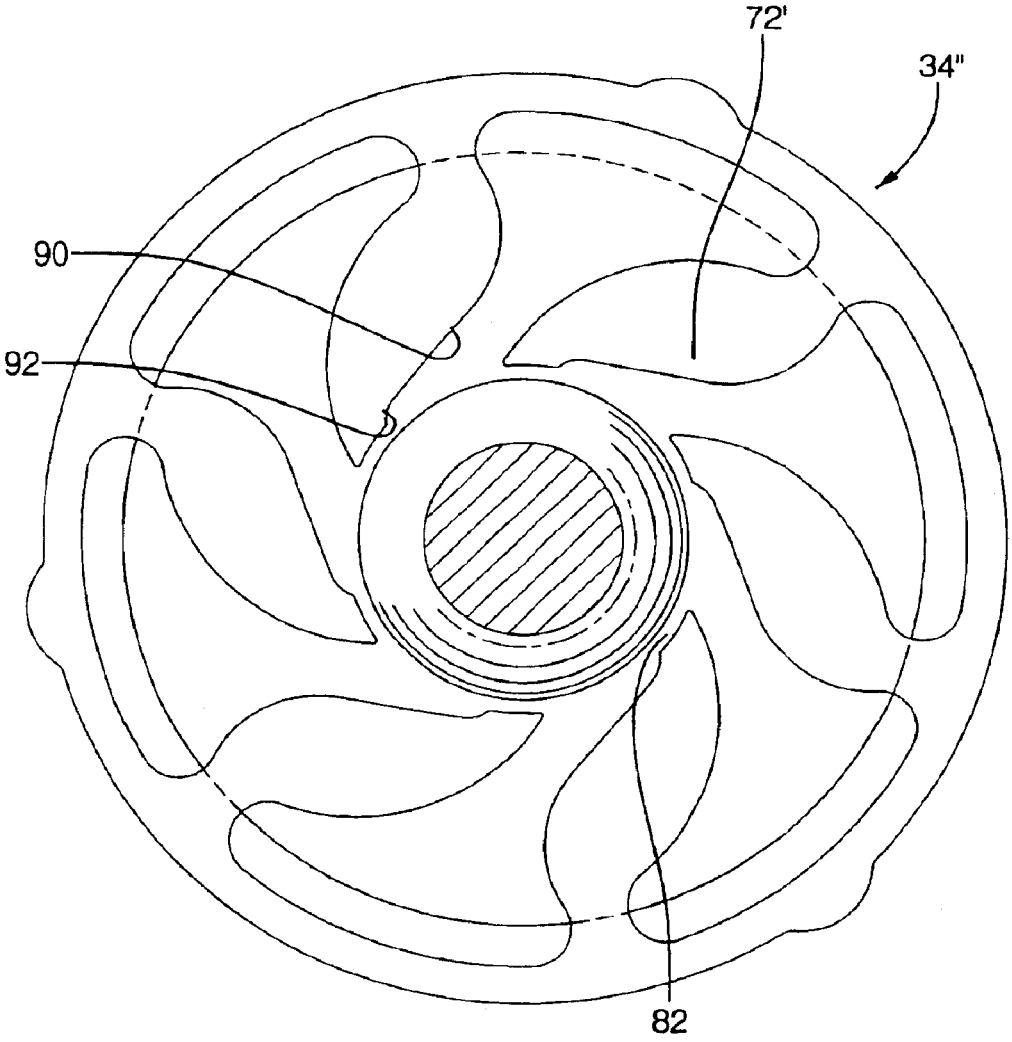
FIG. 6 is a third embodiment of a swirl plate.

These benefits allow for slight variations in swirler geometry design as desired, so that a wide range of atomizers, addressing specific performance parameters, may be produced. Three slight variations in swirler geometry have been developed to optimize specific performance parameters. In addition to the geometry variations, the metering region cross-section 78 may be varied to cover a range of spray angle and flow rate applications. The three variations can be described as:

1) a tangent slot swirler (shown in FIG. 4) wherein the outer wall of the passage in the exit region is tangent to a diameter slightly larger than that of the pintle ball, which design produces a small SAC spray with an acceptable pressure drop;

2) an offset annulus slot swirler 34' (FIG. 5), having a larger swirl annulus 82', wherein the outer wall 88 of the passage in the exit region is offset 90 from the swirl annulus by an additional 25%, the mean flow in the exit passage then being tangent to the pintle ball, which design has the lowest pressure drop but at the expense of increased SAC spray; and 3) a hook-slot swirler 34" (FIG. 6), wherein the offset 90 is the same as in the offset annulus slot swirler 34' but the outer wall curves inward 92 near the tip of land 72' to about the same diameter of swirl annulus 82 as in FIG.4, resulting in reduced SAC spray.

Additionally, the ratio of plate thickness and passage width is selected to minimize the cross-sectional flow area variation. Preferably, the passage width is about twice the plate thickness. This is because typical variation in plate thickness is about one half the variation in slot width for the PCM process. If a stamping process is used, then the height-to-width ratio should be adjusted accordingly to match known processes characteristics. Each plate design may be produced from sheet stock of various thicknesses and in a variety of metering region widths as required to meet the flow requirements of most known fuel injectors.

While the invention has been described as having a preferred design, the present invention may be further modified within the spirit and scope of this disclosure as may occur to those skilled in the art. This application is therefore intended to cover any and all variations, uses, or adaptations of the present invention using the general principles disclosed herein. Further, this application is intended to cover such departures from the present disclosure as may come within the known or customary practice in the art to which this invention pertains and which may fall within the limits of the appended claims.

What is claimed is:

1. A pressure-swirl plate for causing swirling of fuel in a fuel injector, said plate having an axis and comprising:

a) an outer rim; and b) a plurality of lands attached to said outer rim and extending inwardly therefrom, said lands being spaced apart from each other circumferentially along said rim to define fuel flow passages therebetween, said flow passages terminating conjointly in a circular central open region of said plate, said lands having curved edges defining curved first and second opposing lateral walls of said flow passages, said lateral walls of each of said passages mutually converging between said outer rim and said central open region to accelerate fuel flowing through said passages and to discharge said accelerated fuel in a swirl annulus in said central open region.

2. A plate in accordance with claim 1 wherein said plate is substantially flat.

3. A plate in accordance with claim 1 comprising at least four of said lands.

4. A plate in accordance with claim 1 comprising six of said lands and six of said passages.

5. A plate in accordance with claim 4 wherein said lands are equally spaced along said rim such that said six lands are identical in form and said six passages are identical in form.

6. A plate in accordance with claim 1 wherein said first curved wall includes a first blend radius formed in a first radial direction at a first radial length and said second curved wall includes a second blend radius formed in a second radial direction at a second radial length.

7. A plate in accordance with claim 6 wherein radial curvatures of said first and second radii are different.

8. A plate in accordance with claim 1 wherein one of said curving lateral walls of each of said passages includes an edge tangent to said circular central open region.

9. A plate in accordance with claim 1 wherein each of said flow passages includes:

a) an outer reservoir region wherein fuel is received from a source;

b) an inwardly converging region wherein said first and second curved walls converge and wherein fuel from said reservoir region is both accelerated and turned partially in a direction tangential to said axis of said plate;

c) a metering region wherein said walls are substantially parallel; and d) an exit region wherein fuel from said metering region is discharged into said central open region.

10. A plate in accordance with claim 1 formed from full-hard stainless steel.

11. A plate in accordance with claim 1 formed by a process selected from the group consisting of stamping and photochemical machining.

12. A fuel injector nozzle, comprising:

a) a body having a bore terminating in a plate seat, and having a conical valve seat and outlet passage;

b) a generally planar pressure-swirl plate disposed on said plate seat, said plate including an outer rim and a plurality of lands attached to said outer rim and extending inwardly therefrom, said lands being spaced apart from each other circumferentially along said rim to define fuel flow passages therebetween, said flow passages terminating conjointly in a circular central open region of said plate, said lands having curved edges defining curved first and second opposing lateral walls of said flow passages, said lateral walls of each of said passages mutually converging between said outer rim and said central open region to accelerate fuel flowing through said passages and to discharge said accelerated fuel in a swirl annulus in said central open region; and c) a plate retainer disposed in said bore adjacent said plate for retaining said plate in said bore.

13. A nozzle in accordance with claim 12 wherein said plate retainer includes a central bore for admitting and guiding a pintle ball and shaft.

14. A nozzle in accordance with claim 13 wherein said pintle ball is disposed within said central open region of said plate to form said swirl annulus.

15. A nozzle in accordance with claim 14 wherein the center of said pintle ball is disposed offset from said plane of said pressure swirl plate.

16. A nozzle in accordance with claim 12 wherein said conical valve seat has an included angle of about 90°.

17. A nozzle in accordance with claim 12 wherein said plate is selected from the group consisting of tangent slot swirler, offset annulus slot swirler, and hook slot swirler.

18. A fuel injector, comprising a fuel injector nozzle that includes a body having a bore terminating in a plate seat, and having a conical valve seat and outlet passage, a pressure-swirl plate disposed on said plate seat, said plate including an outer rim and a plurality of lands attached to said outer rim and extending inwardly therefrom, said lands being spaced apart from each other circumferentially along said rim to define fuel flow passages therebetween, said flow passages terminating conjointly in a circular central open region of said plate, said lands having curved edges defining curved first and second opposing lateral walls of said flow passages, said lateral walls of each of said passages mutually converging between said outer rim and said central open region to accelerate fuel flowing through said passages and to discharge said accelerated fuel in a swirl annulus in said central open region, and a plate retainer disposed in said bore adjacent said plate for retaining said plate in said bore.

19. A pressure-swirl plate for causing swirling of fuel in a fuel injector, said plate having an axis and comprising:

a) an outer rim; and b) a plurality of lands attached to said outer rim and extending inwardly therefrom, said lands being spaced apart from each other circumferentially along said rim to define fuel flow passages therebetween, said flow passages terminating conjointly in a circular central open region of said plate, said lands having edges defining first and second opposing lateral walls of said flow passages, said lateral walls of each of said passages mutually converging between said outer rim and said central open region to accelerate fuel flowing through said passages and to discharge said accelerated fuel in a swirl annulus in said central open region, wherein each of said flow passages includes:

i) an outer reservoir region wherein fuel is received from a source;

ii) an inwardly converging region wherein said first and second walls converge and wherein fuel from said reservoir region is both accelerated and turned partially in a direction tangential to said axis of said plate;

iii) a metering region; and iv) an exit region wherein fuel from said metering region is discharged into said central open region.

* * * * *